US011998057B2

(12) United States Patent
Moloney et al.

(10) Patent No.: US 11,998,057 B2
(45) Date of Patent: Jun. 4, 2024

(54) APPARATUS FOR GENERATION AEROSOL FROM AN AEROSOLIZABLE MEDIUM, AN ARTICLE OF AEROSOLIZABLE MEDIUM AND A METHOD OF OPERATING AN AEROSOL GENERATING APPARATUS

(71) Applicant: NICOVENTURES TRADING LIMITED, London (GB)

(72) Inventors: Patrick Moloney, London (GB); Anton Korus, London (GB); Justin Han Yang Chan, London (GB)

(73) Assignee: NICOVENTURES TRADING LIMITED, London (GB)

( * ) Notice: Subject to any disclaimer, the term of this patent is extended or adjusted under 35 U.S.C. 154(b) by 885 days.

(21) Appl. No.: 15/733,693

(22) PCT Filed: Mar. 27, 2019

(86) PCT No.: PCT/EP2019/057782
§ 371 (c)(1),
(2) Date: Sep. 29, 2020

(87) PCT Pub. No.: WO2019/185747
PCT Pub. Date: Oct. 3, 2019

(65) Prior Publication Data

US 2021/0015161 A1 Jan. 21, 2021

(30) Foreign Application Priority Data

Mar. 29, 2018 (GB) ..... 1805263

(51) Int. Cl.
*A24F 40/53* (2020.01)
*A24F 40/40* (2020.01)
(Continued)

(52) U.S. Cl.
CPC ..... *A24F 40/53* (2020.01); *A24F 40/40* (2020.01); *A24F 40/51* (2020.01); *A24F 40/57* (2020.01); *A24F 40/20* (2020.01)

(58) Field of Classification Search
CPC ..... A24F 40/10; A24F 40/50; A24F 40/51; A24F 40/53; A24F 40/60; A24F 40/20; A24F 40/30
See application file for complete search history.

(56) References Cited

U.S. PATENT DOCUMENTS 6,040,560 A 3/2000 Fleischhauer et al.
11,064,725 B2 * 7/2021 Wilke ..... A24C 5/01
(Continued)

FOREIGN PATENT DOCUMENTS

AU 2019241463 B2 3/2019
CA 2858479 A1 7/2013
(Continued)

*Primary Examiner* — Truc T Nguyen
(74) *Attorney, Agent, or Firm* — Burr & Forman LLP

(57) ABSTRACT

An apparatus for generating aerosol from an aerosolizable medium is disclosed. The apparatus includes a housing; a chamber for receiving an article, a sensor and a cover system. The article includes an aerosolizable medium and a detectable element provided in association with the article. The sensor is configured to sense the detectable element when an article is received within the chamber. The cover system can be configured in at least a first configuration to substantially cover the sensor, and a second configuration, in which a field of view of the sensor is substantially without obstruction.

26 Claims, 7 Drawing Sheets

(51) Int. Cl.

| | |
|---|---|
| ***A24F 40/51*** | (2020.01) |
| ***A24F 40/57*** | (2020.01) |
| *A24F 40/20* | (2020.01) |

(56) References Cited

U.S. PATENT DOCUMENTS

| | | | | |
|---|---|---|---|---|
| 11,751,859 | B2 * | 9/2023 | Lampropoulos | A61B 17/0057 606/213 |
| 2005/0154271 | A1 | 7/2005 | Rasdal et al. | |
| 2013/0087144 | A1 | 4/2013 | Todd | |
| 2014/0196736 | A1 | 7/2014 | Fernando et al. | |
| 2015/0189695 | A1 | 7/2015 | Xiang et al. | |
| 2017/0020196 | A1 * | 1/2017 | Cameron | A24F 40/60 |
| 2017/0119058 | A1 * | 5/2017 | Cameron | A24B 15/167 |
| 2017/0181471 | A1 | 6/2017 | Phillips et al. | |
| 2017/0303589 | A1 * | 10/2017 | Cameron | A24F 40/40 |
| 2017/0304563 | A1 | 10/2017 | Adelson | |
| 2017/0332702 | A1 * | 11/2017 | Cameron | A24F 40/65 |
| 2017/0368273 | A1 * | 12/2017 | Rubin | A61M 16/0093 |
| 2018/0104214 | A1 | 4/2018 | Raichman et al. | |
| 2018/0168229 | A1 * | 6/2018 | Mazur | A24F 40/53 |
| 2019/0328038 | A1 * | 10/2019 | Huang | H05B 1/0227 |
| 2020/0022416 | A1 * | 1/2020 | Alarcon | A24F 40/57 |
| 2020/0187565 | A1 * | 6/2020 | Williams | A61M 11/005 |
| 2020/0245694 | A1 * | 8/2020 | Cameron | B05B 17/0607 |
| 2021/0015161 | A1 | 1/2021 | Moloney et al. | |

FOREIGN PATENT DOCUMENTS

| | | | | |
|---|---|---|---|---|
| CN | 106231935 | A | 12/2016 | |
| EP | 2201850 | A1 | 6/2010 | |
| JP | 2001502542 | A | 2/2001 | |
| JP | 2012513750 | A | 6/2012 | |
| KR | 20110096548 | A | 8/2011 | |
| KR | 20180018515 | A | 2/2018 | |
| RU | 132954 | U1 | 4/2013 | |
| RU | 2638414 | C1 | 12/2017 | |
| RU | 2021133913 | A | 2/2022 | |
| WO | 2010073122 | A1 | 7/2010 | |
| WO | 2016065532 | A1 | 5/2016 | |
| WO | 2017029088 | A1 | 2/2017 | |
| WO | 2017029089 | A1 | 2/2017 | |
| WO | 2019129378 | A1 | 7/2019 | |
| WO | WO 2019129378 | * | 7/2019 | A24F 47/00 |
| WO | 2019185747 | A1 | 10/2019 | |

* cited by examiner

APPARATUS FOR GENERATION AEROSOL FROM AN AEROSOLIZABLE MEDIUM, AN ARTICLE OF AEROSOLIZABLE MEDIUM AND A METHOD OF OPERATING AN AEROSOL GENERATING APPARATUS

PRIORITY CLAIM

The present application is a National Phase entry of PCT Application No. PCT/EP2019/057782, filed Mar. 27, 2019, which claims priority from GB Patent Application No. 1805263.9, filed Mar. 29, 2018, each of which is hereby fully incorporated herein by reference.

TECHNICAL FIELD

The present disclosure relates to an apparatus for generating aerosol from an aerosolizable medium, an article of aerosolizable medium, a system including an apparatus for generating aerosol from an aerosolizable medium and an article of aerosolizable medium and a method of operating the apparatus for generating aerosol from an aerosolizable medium.

BACKGROUND

Articles such as cigarettes, cigars and the like burn tobacco during use to create tobacco smoke. Attempts have been made to provide alternatives to these articles by creating products that release compounds without combusting. Examples of such products are so-called "heat not burn" products, also known as tobacco heating products or tobacco heating apparatus, which release compounds by heating, but not burning, material.

SUMMARY

In a first example, there is provided an apparatus for generating aerosol from an aerosolizable medium. The apparatus comprises: a housing; a chamber for receiving an article, the article comprising: an aerosolizable medium; and detectable element provided in association with the article; a sensor configured to sense the detectable element when an article is received within the chamber; and a cover system. The cover system can be configured in at least a first configuration to substantially cover the sensor, and a second configuration, in which a field of view of the sensor is substantially without obstruction.

In a second example, there is provided an apparatus for generating aerosol from an aerosolizable medium. The apparatus comprises: a housing; a chamber for receiving an article, the article comprising: an aerosolizable medium; and an optically detectable indicia provided in association with the article; an optical sensor configured to sense the indicia when an article is received within the chamber; and a cover system. The cover system can be configured in at least a first configuration to substantially cover the optical sensor, and a second configuration, in which a field of view of the optical sensor is substantially without obstruction.

In a third example, there is provided an aerosol provision system comprising an apparatus; and an article comprising: an aerosolizable medium; and an optically detectable indicia.

In a fourth example, there is provided a method of operating an aerosol generating apparatus having an optical sensor. The method comprises: monitoring for the presence of an article for use with the aerosol generating apparatus, the article comprising an aerosolizable medium and an indicia; sensing, by the optical sensor, the indicia of the article; operating the aerosol generating apparatus based on the sensed indicia; and closing the cover system after the sensing the indicia of the article.

In a fifth example, there is provided an apparatus for generating aerosol from an aerosolizable medium. The apparatus comprises: a chamber for receiving an article, the article comprising: an aerosolizable medium; and an indicia; and an optical sensor arrangement for reading the indicia. A surface of optical sensor arrangement is positioned to contact the article received within the chamber in use.

In a sixth example, there is provided an article comprising: an aerosolizable medium; and an indicia. At least a portion of an outer surface of the article is compressible and configured to contact an optical sensor arrangement of an apparatus, the apparatus arranged to receive the article and aerosolize the aerosolizable medium of the article, during insertion of the article into the apparatus for generating aerosol from an aerosolizable medium.

In a seventh example, there is provided a method of cleaning an apparatus for generating aerosol from an aerosolizable medium. The apparatus comprises: a chamber for receiving an article comprising an aerosolizable medium, and an optical sensor arrangement. The method comprises: inserting an article comprising an aerosolizable medium into the chamber; and wiping a surface of the optical sensor arrangement with a surface of the article during at least part of the inserting.

In an eighth example, there is provided an apparatus for generating aerosol from an aerosolizable medium. The apparatus comprises: a chamber for receiving an article, the article comprising an aerosolizable medium and an indicia, wherein the chamber defines a longitudinal axis; and a sensor for reading the indicia received within the chamber in use. The sensor is spaced from the chamber to define a gap between the sensor and the article received within the chamber in use, wherein the sensor is spaced from the chamber in a direction not parallel to the longitudinal axis.

In a ninth example, there is provided an apparatus for generating aerosol from an aerosolizable medium. The apparatus comprises: a housing; a chamber for receiving an article, the article comprising: an aerosolizable medium; and detectable element provided in association with the article; a sensor configured to sense the detectable element when an article is received within the chamber; and a replaceable cover. The replaceable cover is positioned over the sensor and has substantially no impact on the operation of the sensor.

Further features and advantages of the disclosure will become apparent from the following description of embodiments of the disclosure, given by way of example only, which is made with reference to the accompanying drawings.

DETAILED DESCRIPTION

As used herein, the terms "aerosolizable medium" includes materials that provide volatilized components upon heating, typically in the form of an aerosol. "Aerosolizable medium" includes any tobacco-containing material and may, for example, include one or more of tobacco, tobacco derivatives, expanded tobacco, reconstituted tobacco or tobacco substitutes. "Aerosolizable medium" also may include other, non-tobacco, products, which, depending on the product, may or may not contain nicotine. "Aerosolizable medium" may for example be in the form of a solid, a liquid, a gel or a wax or the like. "Aerosolizable medium" may for example also be a combination or a blend of materials.

The present disclosure relates to apparatus that heats an aerosolizable medium to volatilize at least one component of the aerosolizable medium, typically to form an aerosol which can be inhaled, without burning or combusting the aerosolizable medium. Such apparatus is sometimes described as a "heat-not-burn" apparatus or a "tobacco heating product" or "tobacco heating device" or similar. Similarly, there are also so-called e-cigarette devices, which typically vaporize an aerosolizable medium in the form of a liquid, which may or may not contain nicotine. The aerosolizable medium may be in the form of or provided as part of a rod, cartridge or cassette or the like which can be inserted into the apparatus. One or more aerosol generating elements for volatilizing the aerosolizable medium may be provided as a "permanent" part of the apparatus or may be provided as part of the consumable which is discarded and replaced after use. In one example, the one or more aerosol generating elements may be in the form of a heater arrangement.

Figure 1:
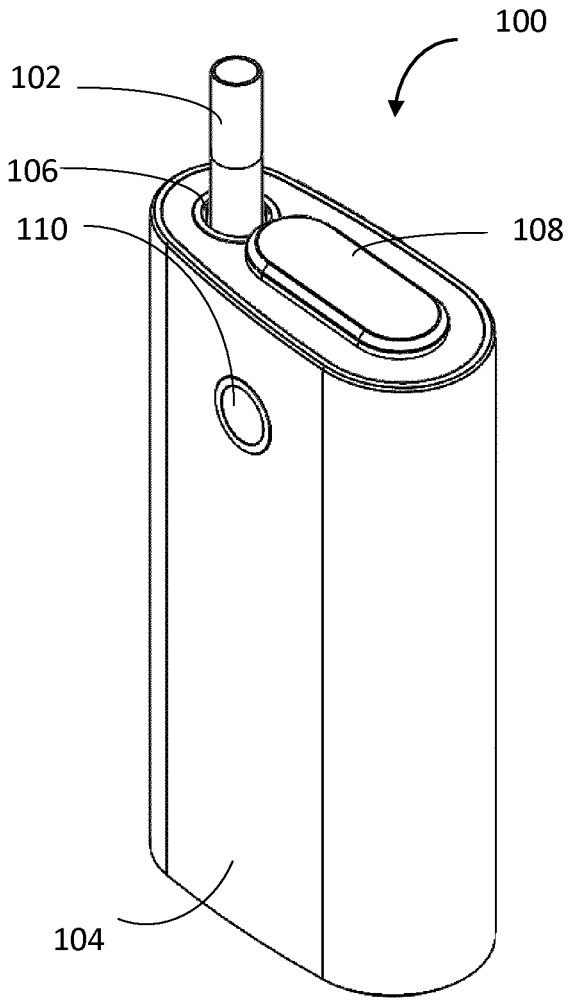
FIG. 1 shows a perspective view of an example of an apparatus for heating an article comprising aerosolizable medium.
Figure 2:
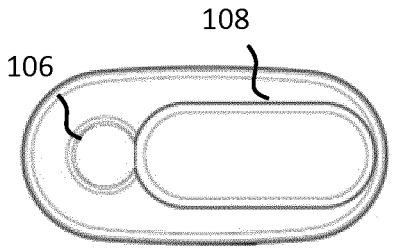
FIG. 2 shows a top view of an example of an apparatus for heating an article comprising aerosolizable medium.

FIG. 1 shows an example of an apparatus 100 for generating an aerosolizable medium. The apparatus 100 may be an aerosol provision device. In broad outline, the apparatus 100 may be used to heat a replaceable article 102 comprising an aerosolizable medium, to generate an aerosol or other inhalable medium which is inhaled by a user of the apparatus 100. FIG. 2 shows a top view of the example of the apparatus 100 shown in FIG. 1.

The apparatus 100 comprises a housing 104. The housing 104 has an opening 106 in one end, through which the article 102 may be inserted into a heating chamber (not shown). In use, the article 102 may be fully or partially inserted into the chamber. The heating chamber may be heated by one or more heating elements (not shown). The apparatus 100 may also comprise a lid, or cap 108, to cover the opening 106 when no article 102 is in place. In FIGS. 1 and 2, the cap 108 is shown in an open configuration, however the cap 108 may move, for example by sliding, into a closed configuration. The apparatus 100 may include a user-operable control element 110, such as a button or switch, which operates the apparatus 100 when pressed.

Figure 3:
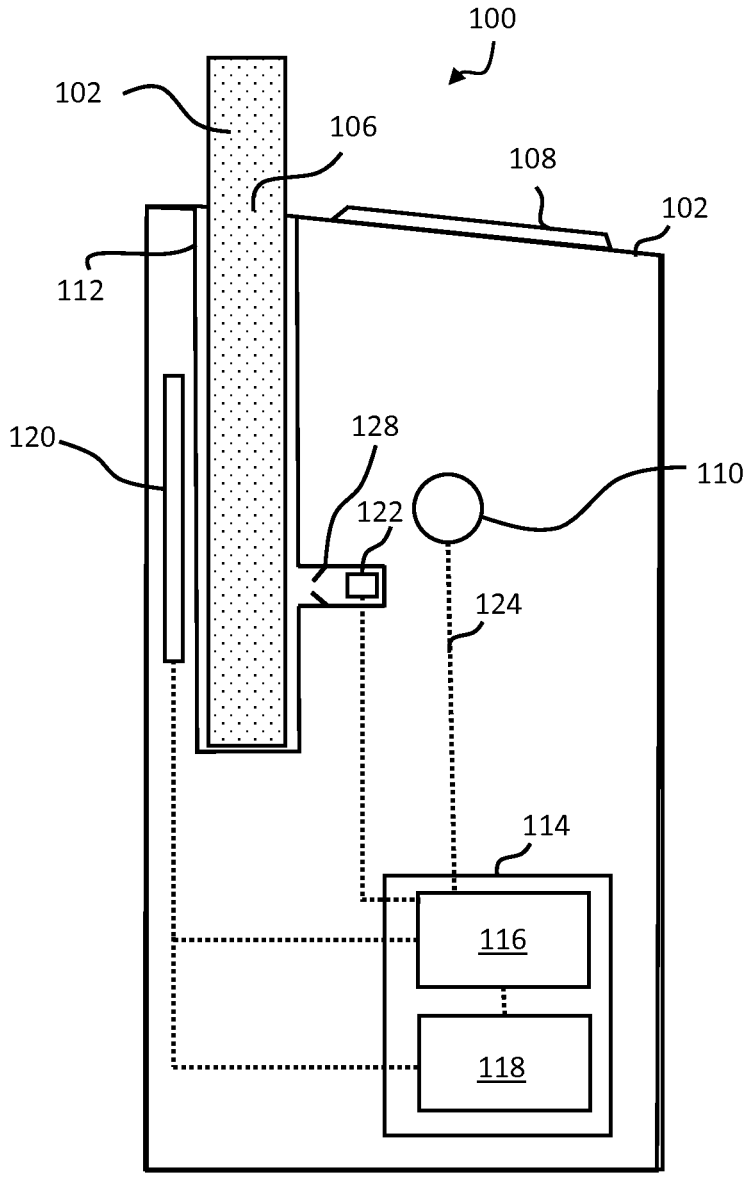
FIG. 3 shows a cross-sectional view of the example apparatus of FIG. 1.

FIG. 3 shows a cross-sectional view of an example of an apparatus 100 as shown in FIG. 1. The apparatus 100 has a receptacle, or heating chamber 112 which is configured to receive the article 102 to be heated. In one example, the heating chamber 112 is generally in the form of a hollow cylindrical tube into which an article 102 comprising an aerosolizable medium is inserted for heating in use. However, different arrangements for the heating chamber 112 are possible. In the example of FIG. 3, an article 102 comprising an aerosolizable medium has been inserted into the heating chamber 112. The article 102 in this example is an elongate cylindrical rod, although the article 102 may take any suitable shape. In this example, an end of the article 102 projects out of the apparatus 100 through the opening 106 of the housing 104 such that user may inhale the aerosol through the article 102 in use. The end of the article 102 projecting from the apparatus 100 may include a filter material. In other examples the article 102 is fully received within the heating chamber 112 such that it does not project out of the apparatus 100. In such a case, the user may inhale the aerosol directly from the opening 106, or via a mouthpiece which may be connected to the housing 102 around the opening 106.

The apparatus 100 comprises one or more aerosol generating elements. In one example, the aerosol generating elements are in the form of a heater arrangement 120 arranged to heat the article 102 located within the chamber 112. In one example the heater arrangement 120 comprises resistive heating elements that heat up when an electric current is applied to them. In other examples, the heater arrangement 120 may comprise a susceptor material that is heated via induction heating. In the example of the heater arrangement 120 comprising a susceptor material, the apparatus 100 also comprises one or more induction elements which generate a varying magnetic field that penetrate the heater arrangement 120. The heater arrangement may be located internally or externally of the heating chamber 112. In one example, the heater arrangement may comprise a thin film heater that is wrapped around an external surface of the heating chamber 112. For example, the heater arrangement 120 may be formed as a single heater or may be formed of a plurality of heaters aligned along the longitudinal axis of the heating chamber 112. The heating chamber 112 may be annular or tubular, or at least part-annular or part-tubular around its circumference. In one particular example, the heating chamber 112 is defined by a stainless steel support tube. The heating chamber 112 is dimensioned so that substantially the whole of the aerosolizable medium in the article 102 is located within the heating chamber 112, in use, so that substantially the whole of the aerosolizable medium may be heated. In other examples, the heater arrangement 120 may include a susceptor that is located on or in the article 102, wherein the susceptor material is heatable via a varying magnetic field generated by the apparatus 100. The heating chamber 112 may be arranged so that selected zones of the aerosolizable medium can be independently heated, for example in turn (over time) or together (simultaneously), as desired.

In some examples, the apparatus 100 includes an electronics compartment 114 that houses electrical control circuitry or controller 116 and/or a power source 118, such as a battery. In other examples, a dedicated electronics compartment may not be provided and the controller 116 and power source 118 are located generally within the apparatus 100. The electrical control circuitry or controller 116 may include a microprocessor arrangement, configured and arranged to control the heating of the aerosolizable medium as discussed further below. The apparatus 100 includes a sensor arrangement 122 configured to sense a marker arrangement or indicia 126 indicative of a parameter associated with the article 102, as discussed further below.

In some examples, the controller 116 is configured to receive one or more inputs/signals from the sensor arrangement 122. The controller 116 may also receive a signal from the control element 110 and activate the heater arrangement 120 in response to the received signal and the received inputs. Electronic elements within the apparatus 100 may be electrically connected via one or more connecting elements 124, shown depicted as dashed lines.

The power source 118 may be, for example, a battery, such as a rechargeable battery or a non-rechargeable battery. Examples of suitable batteries include, for example, a lithium-ion battery, a nickel battery (such as a nickel-cadmium battery), an alkaline battery and/or the like. The battery is electrically coupled to the one or more heaters to supply electrical power when required and under control of the controller 116 to heat the aerosolizable medium without causing the aerosolizable medium to combust. Locating the power source 118 adjacent to the heater arrangement 120 means that a physically large power source 118 may be used without causing the apparatus 100 as a whole to be unduly lengthy. As will be understood, in general a physically large power source 118 has a higher capacity (that is, the total electrical energy that can be supplied, often measured in Amp-hours or the like) and thus the battery life for the apparatus 100 can be longer.

It is sometimes desirable for the apparatus to be able to identify or recognize the particular article 102 that has been introduced into the apparatus 100, without further input from the user. For example, the apparatus 100, including, in particular, the heating control provided by the controller 116, will often be optimized for a particular arrangement of the article 102. Examples include control on the basis of one or more of size, shape, particular smokable material, etc. It would be undesirable for the apparatus 100 to be used with an aerosol medium or an article 102 having different characteristics.

In addition, if the apparatus 100 can identify or recognize the particular article 102, or at least the general type of article 102, that has been introduced into the apparatus 100, this can help eliminate or at least reduce counterfeit or other non-genuine articles 102 being used with the apparatus 100.

In one example, the sensor arrangement 122, in the form of an optical sensor, is configured to sense the indicia 126 indicative of a parameter associated with the article 102. A problem with the use of an optical sensor to read the indicia 126 on the article 102 is that particles from the aerosol may deposit of a surface of the optical sensor, thus impairing the ability of the optical sensor to read or sense the indicia 126. In other cases, other components might also be deposited on the sensor, such as non-aerosolized particles from the article 102, or condensate. Therefore, it is advantageous to prevent or reduce the amount of deposits on the surface of the optical sensor or alternatively provide means for removing any deposits on the surface of the optical sensor. References to "optical" include any optical sensing system including those which operate using visible light, Infra-Red (IR) and Ultra-violet (UV).

In some examples, the sensor arrangement may comprise a first sensor (not shown) and a second sensor (not shown). The first sensor, may be a detection sensor, that is configured to detect the presence of the article 102 in the chamber 112, for example, by monitoring for the presence of a reference marker 125 on the article 102. The second sensor is configured to sense the indicia 126 indicative of a parameter associated with the article 102. In some examples, the first sensor and the second sensor are spaced apart from each other at approximately the same distance as the reference marker 125 and the indicia 126*b*. Spacing the first sensor and the second sensor apart from each other at approximately the same distance as the reference marker 125 and the indicia 126 provides an additional authenticity check.

The sensor arrangement 122 may provide one or more inputs to the controller 116, based on the sensed indicia 126. The controller 116 may determine a parameter of the article 102, such as whether the article 102 is a genuine article, based on the received one or more inputs. The controller 116 may activate the heater arrangement 120 depending on the determined parameter of the article 102. The apparatus 100 is therefore provided with means of detecting whether the article 102 is a genuine product or not and may alter the operation of the apparatus 100 accordingly, for example, by preventing supply of power to the heater arrangement 120 if a non-genuine article is detected. Preventing use of the apparatus 100 when a non-genuine article is inserted into the apparatus 100 would reduce the likelihood of consumers having a poor experience due to the use of illicit consumables.

In some examples, the controller 116 is able to determine a parameter of the article 102 based on the received one or more inputs from the sensor arrangement 122 and tailor the heat profile provided by the heater arrangement 120 based on the determined parameter. The heater arrangement 120 of the apparatus 100 may be configured to provide a first heating profile if the indicia of the article 102 has a first characteristic (for example, by the controller 116 controlling the supply of power) and the heater arrangement 120 is configured to provide a second heating profile if the indicia has a second characteristic different from the first characteristic. For example, the apparatus 100 may be able to determine whether the consumable is a solid or a non-solid consumable and adjust the heating profile accordingly. In other examples, the apparatus 100 may be able to distinguish between different blends of tobacco in the article 102 and tailor the heating profile accordingly to provide an optimized heating profile for the specific blend of tobacco that has been inserted into the apparatus 100.

Figure 4:
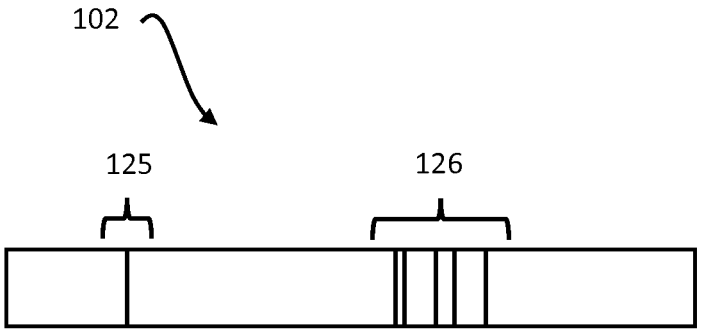
FIG. 4 shows a side view of an example of an article comprising an aerosolizable medium.

FIG. 4 shows a schematic longitudinal side view of an example of an article 102 comprising aerosolizable medium for use with the apparatus 100. In some examples, the article 102 also comprises a filter arrangement (not shown) in addition to the aerosolizable medium.

The article 102 also comprises an indicia 126 that is configured to be sensed by the sensor arrangement 122, in the form of an optical sensor, of the apparatus 100. The indicia may be made up of marker elements and represents encoded information indicative of a parameter of the article 102. As mentioned above, the parameter may indicate the maker of the article 102, such that the article 102 can be confirmed as genuine. In other examples, the parameter may indicate the type of aerosolizable medium in the article 102, such as whether the aerosolizable medium is in the form of a solid, liquid or gel. The parameter may also be indicative of a variant of the aerosolizable medium, such as whether the aerosolizable medium comprises Burley tobacco or Virginia tobacco. In other examples, the parameter may indicate a heating profile that should be used to heat the article 102. The parameter may indicate other characteristics of the article 102. Providing an indicia 126 allows the apparatus 100 to provide a tailored experience for the user based on the identification information of the article 102.

In some examples, the article 102 also includes a reference marker 125. The reference marker 125 may be configured to be sensed by a second sensor, in the form of a detection sensor, to indicate the presence of the article 102. The reference marker 125 may be made up of one or more marker elements, as described below.

The indicia 126 may comprise an optical characteristic, for example, in FIG. 4, the indicia 126 is in the form of a plurality of lines on the outside of the article 102. In FIG. 4, the lines are shown as being uniform width, but in other examples, the width of the lines may be varied. In the example of FIG. 4, the indicia 126 is indicative of an encoded parameter associated with the article 102. The indicia 126, once read, may be compared to a look-up table (LUT) storing a correspondence between data associated with the indicia (e.g., a binary sequence indicated by the indicia) and a heating profile or other action associated with the apparatus. In addition, the data associated with the indicia may be encoded according to a secret key common to all aerosol provision apparatus from a certain manufacturer/geographic origin, and the apparatus is configured to decode the encoded data before searching for the decoded data in the LUT.

In the example of the article 102 being cylindrical, the one or more marker elements, such as lines, may extend part of the way around the perimeter or circumference of the article 102 or all of the way around the perimeter of the article 102. In some examples the sensor arrangement 122 configured to sense the indicia 126 may be arranged at a specific location within the apparatus 100. For example, the sensor arrangement 122 may be arranged adjacent to one side of the chamber 112 and may have a limited detection range. Providing marker elements that extend all of the way around the perimeter of the article 102 facilitates the sensing of the indicia 126 by the sensor arrangement 122 irrespective of the particular orientation of the article 102 within the apparatus 100.

The indicia 126 may be formed in a number of different ways, and be formed of a number of different materials, depending on the particular sensor arrangement 122 of the apparatus 100 with which the article 102 is intended to be used. The indicia 126 may comprise optical features such as lines, gaps or notches, surface roughness, and/or reflective material. The indicia 126 may comprise optical features such as a barcode or a QR code. In one example, the indicia 126 comprises fluorescent features.

In one example, the reference marker 125 includes electrically conductive features such and the first sensor is in the form of a capacitive second sensor configured to detect a change in capacitance or resistance when the article 102 is inserted into the apparatus 100. Providing a non-optical sensor arrangement in addition to the optical sensor 122 may potentially be more robust compared with an optical sensor because it would not be affected by deposition on an optical sensor or degradation of optical sensor over the life of the apparatus 100. Non-optical sensors may be in the form of RF sensors or a hall effect sensor along with a permanent magnet or an electromagnet and a hall effect sensor.

Figure 5:
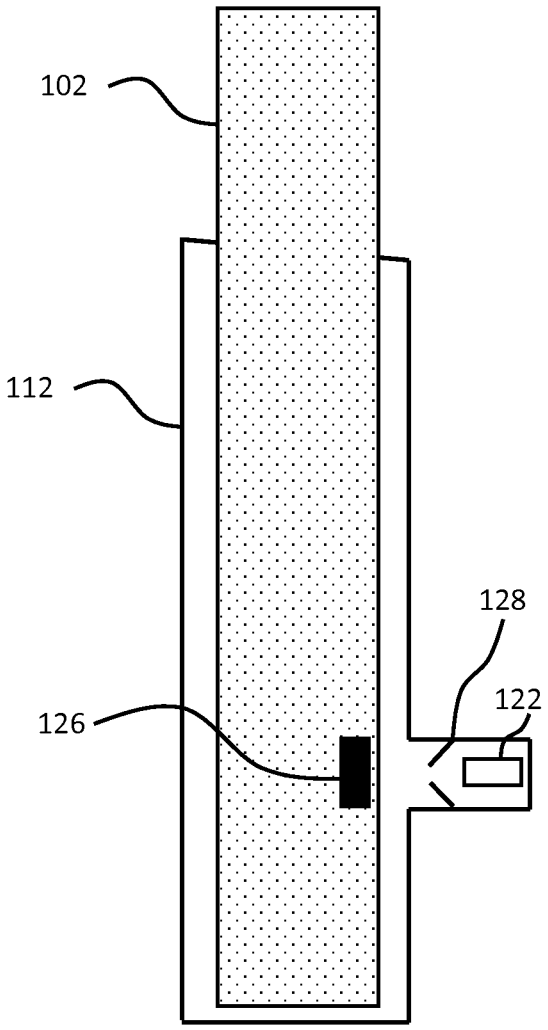
FIG. 5 shows an example cross-sectional view of a chamber, article and sensor arrangement.

FIG. 5 shows a cross-sectional view of an example device, article and sensor. A cover system 128 is located between the sensor 122 and the chamber 112. The cover system 128 can be configured in at least a first configuration to substantially cover the sensor 122, and a second configuration, in which a field of view of the sensor 122 is substantially without obstruction.

In one example, the cover system 128 is arranged such that the sensor 122 is able to sense the marker 126 on the article 102 when the cover 128 is open, i.e. in the second configuration, but not able to sense the marker 126 on the article 102 when the cover system 128 is closed, i.e. in the first configuration. In other examples, the cover system 128 is not opened and closed, but rather moved into the second configuration outside of the field of view of the sensor 122, without opening. The cover system 128 may include any mechanism suitable for moving or opening the cover such as a pivot, slide, spring and latch or an iris mechanism.

In one example, the sensor arrangement 122 includes a second sensor to monitor for the presence of the article 102 in the chamber 112. The second sensor may be configured to detect the reference marker 125 of the article 102 or detect the article 102 directly. In some examples, the second sensor may be in the form of a pressure sensor or switch configured to sense when the article 102 has been inserted into the chamber 112.

In some implementations, the cover system 128 may move into the second configuration responsive to the second sensor determining that the article 102 is present in the chamber 112. The detection sensor may operate by monitoring for the presence of the article 102 or reference marker 125 on the article 102. In one example, the detection sensor non-continuously monitors for the presence of reference marker 125 or article 102. Non-continuous monitoring for the presence of the reference marker 125 is more efficient compared with continuously monitoring for the presence of the reference marker 126*a* as it does not require a constant source of power. In other examples, the cover system 128 may move into the second configuration in response to an input from a user. In yet further examples, the cover system may initially be in the second configuration, e.g., when a user first powers on the device.

The cover system 128 may be configured to return to the first configuration after a pre-determined period of time after opening, for example, the cover system 128 may close after a sufficient time for the indicia 126 to be sensed by the sensor 122. In some examples, the cover system 128 is configured to move to the first configuration 2 seconds after moving to the second configuration, although it should be appreciated that the time of 2 seconds is exemplary only, and the time period may be greater or smaller than 2 seconds depending upon the application at hand. The time period may also be set in accordance with detecting a user input, such as a button press, which may cause power to be supplied to the aerosol generating element of the apparatus (and hence may start aerosol generation), as opposed to the instant where the indicia is read. By closing the cover system 128 after a pre-determined period of time, the sensor 122 may have sufficient time to sense the indicia 126, but also there would be less chance of aerosol particulates or other components being deposited on the surface of the sensor 122. It should be appreciated that, in some implementations, the time period may be chosen based on the aerosol generation response of the apparatus; specifically, the time period may be less than the aerosol generation response of the apparatus. In other words, if the apparatus begins generating aerosol 4 seconds after power is supplied to the aerosol generating element (e.g., a heater), then the cover system 128 may be set to close up to 4 seconds after power is first supplied. In other examples, the cover system 128 is configured to return to the first configuration after the sensor 122 has read the indicia 126.

In one example the apparatus 100 is further configured to determine a property, such as temperature, of the chamber 112 and/or article 102 and operate the cover system 128 on the basis of the determined property. The determined property may be one or more of temperature, humidity and air composition. The determined property of the chamber 112 and/or article 102 may be indicative of the aerosol generation reaching a pre-determined level. As such, the apparatus 100 may be configured to close the cover system 128 once the aerosol generation has reached a pre-determined level.

In one example, the apparatus 100 is configured to cause the cover system 128 to return to the first configuration from the second configuration when a determined temperature of the chamber 112 and/or article 102 is greater than or equal to a first threshold temperature, which may be predetermined.

In one example, the apparatus 100 is configured to enable the cover system 128 to transition from the first configuration to the second configuration when a determined temperature of the chamber 112 and/or article 102 is less than or equal to a second threshold temperature. The second threshold temperature may be predetermined and be equal to or different to the first threshold temperature.

Figure 6:
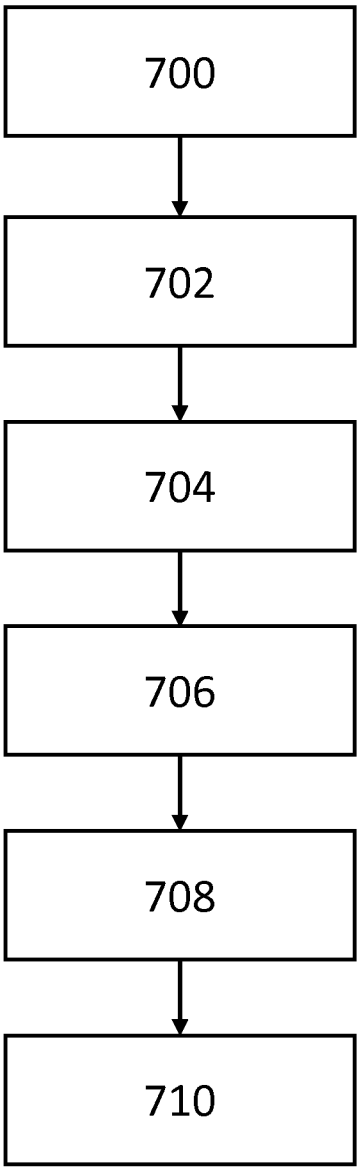
FIG. 6 shows a flow chart of a method for determining a parameter associated with an aerosolizable medium article for use with the example of FIG. 5.

FIG. 6 shows an example of a flow diagram of a method of operating an aerosol generating apparatus having an optical sensor. At block 700, the apparatus 100 monitors for the presence of an article for use with the aerosol generating apparatus, the article comprising an aerosolizable medium 102 an indicia 126 indicative of a parameter of the article 102. At block 702, the apparatus detects, during the monitoring, the presence of the article 102. If the cover system 128 is initially provided in the first, closed configuration, then at block 704, the apparatus, responsive to the detecting, moves a cover system 128 to expose an optical sensor (that is, the cover system 128 is moved to the second, open configuration) before proceeding to block 5706. If the cover system 128 is initially provided in the second, open configuration, then the method proceeds to block 706. At block 706, the optical sensor 122 senses the indicia 126 of the article 102. At block 708, the apparatus operates based on the sensed indicia 126. Thereafter, at block 5710, the cover system 128 transitions to (or back to) the first, closed configuration. As discussed above, this may be based on a pre-determined time after the indicia 126 has been read, or it may be based on sensing another parameter, such as temperature.

In some examples, the cover system 128 is closed after the indicia 126 of the article 102 has been sensed. In some examples, the controller 116 controls the operation of the one or more heaters 120 based on the parameter of said article, for example, if the controller determines that a counterfeit article has been inserted into the apparatus 100, then the heaters are not activated. Alternatively, the controller 116 may determine the type of aerosolizable medium within the article, such as solid, liquid or gel and tailor the heating profile accordingly.

Figure 7:
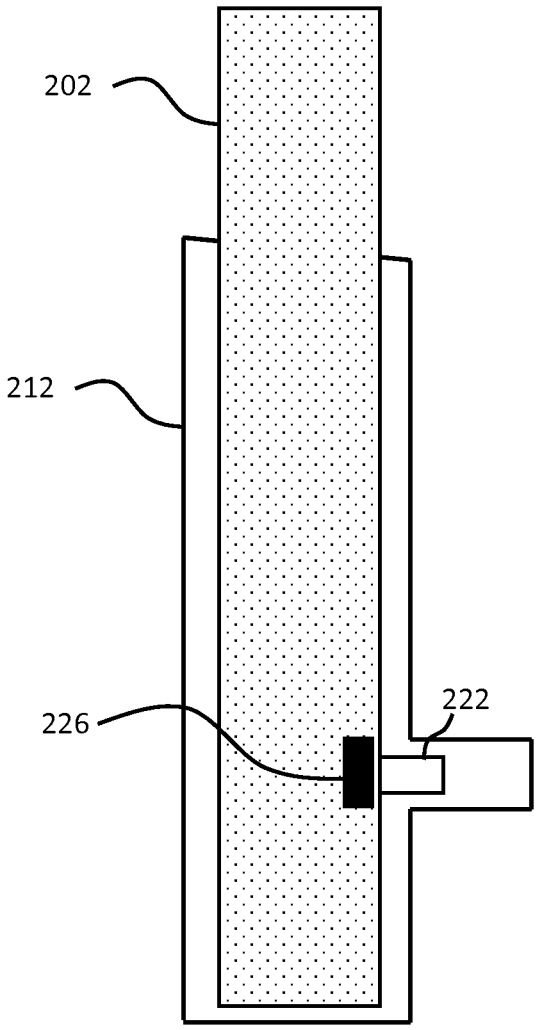
FIG. 7 shows another example cross-sectional view of a chamber, article and sensor arrangement.

FIG. 7 shows an alternative example of the chamber 212, article 202 and sensor arrangement 222, in the form of an optical sensor, of an apparatus for generating aerosol from an aerosolizable medium. In this example, the sensor 222 is configured to contact the article 202 comprising aerosolizable medium received and an indicia 226 received within the chamber 212 in use. As the article 202 is inserted into the chamber 212, it will slide past a surface of the sensor arrangement 222 during insertion so that any residue or deposits on the surface of the sensor will be at least partially removed by the consumable. In one example, the sensor arrangement 222 is retractable, such that it may move from a position where the article 202 will slide against the surface of the sensor 222 as the article 202 is inserted, to a position further away from the article 202. For example, the sensor arrangement could be retracted to give a wider a field of view for sensing the indicia 226. Any suitable mechanism may be implemented in order to retract the sensor arrangement 222.

In one example, the article 202 comprises an aerosolizable medium and an indicia 226. At least a portion of an outer surface of the article 202 is compressible and configured to contact an optical sensor arrangement 222 of the apparatus during insertion of the article 202 into an apparatus for generating aerosol from an aerosolizable medium. The compressible material may comprise silicone or an elastomer in one example. This may wipe material from the surface of the optical sensor arrangement more effectively.

Figure 8:
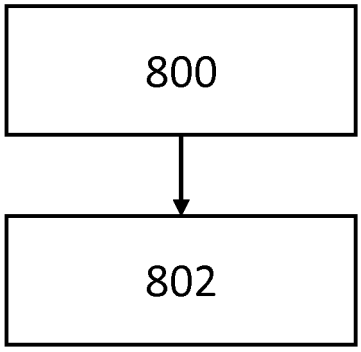
FIG. 8 shows a flow chart of a method for cleaning an apparatus for generating aerosol from an aerosolizable medium article for use with the example of FIG. 7.

FIG. 8 shows an example of a flow diagram of a method of cleaning an apparatus for generating aerosol from an aerosolizable medium, the apparatus comprising: a chamber 212 for receiving an article 202 comprising an aerosolizable medium, and an optical sensor arrangement 222. At block 800, an article 202 comprising an aerosolizable medium is inserted into the chamber 212. At 802, the method includes wiping a surface of the optical sensor arrangement 222 with a surface of the article 202 during at least part of the inserting.

Figure 9:
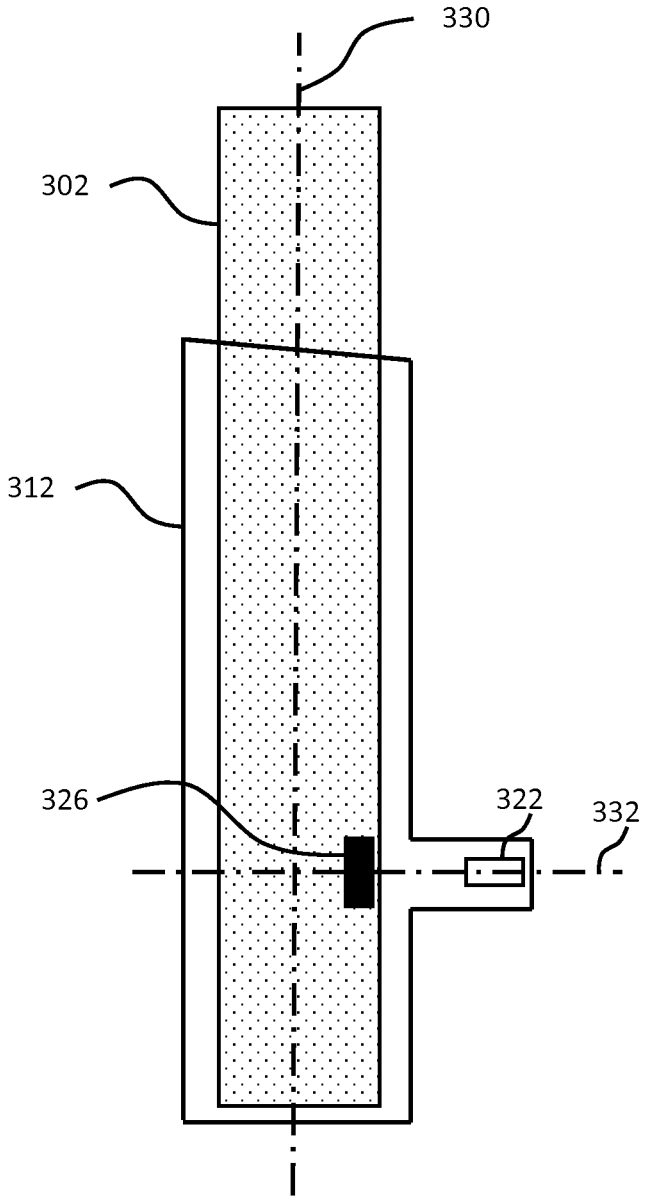
FIG. 9 shows another example cross-sectional view of a chamber, article and sensor arrangement.

FIG. 9 shows an alternative example of the chamber 312, article 302 and sensor arrangement 322, in the form of an optical sensor, of an apparatus for generating aerosol from an aerosolizable medium. In this example, the chamber 312 defines a longitudinal axis 330. The sensor arrangement 322 is configured to read the indicia 326 of the article 302 received within the chamber 312 in use.

In this example, the optical sensor 322 is spaced from the chamber 312 to define a gap between the optical sensor 322 and the article 302 received within the chamber 312 in use. The optical sensor 322 is spaced from the chamber 312 in a direction that is not parallel to the longitudinal axis 330 of the chamber 312. For example, the optical sensor 322 may be radially offset from the chamber 312. The optical sensor 322 is arranged such that it can sense the indicia 326 that is positioned on the side of the article 302. The optical sensor 332 may be provided in a hollow element or recess that is connected to or integral with the chamber 312, for example, the optical sensor 322 may be located in a hollow tube. The hollow tube may have a length and diameter selected such that the pathway for aerosol to the travel to the sensor arrangement 322 is greater than a defined resistance level. For instance, a smaller tube diameter and a longer tube length generally decrease the probability of aerosol particles travelling along the tube and depositing on the sensor arrangement 322. In addition, in some applications, the diameter of the tube may be set dependent on the field of view of the tube and/or the length of the tube may be set based on the focal length of the sensor 322. By way of example only, the hollow tube may have a length of between 0.5 cm and 1.5 cm, or more preferably 1 cm.

In other examples, the hollow tube may have a polygonal cross-sectional. In other examples, the hollow tube may not define a straight line. For example, the tube may be comprised of multiple sections, each section having a longitudinal axis, where the longitudinal axes of two adjacent sections are offset from one another. For instance, in one implementation, the first section of the hollow tube may have a longitudinal axis perpendicular to the longitudinal axis of the chamber 312, and a second section of tube having a longitudinal axis perpendicular to the longitudinal axis of the first section of the tube (i.e., the longitudinal axis of the second section may be parallel to the longitudinal axis of the chamber 312). The optical sensor 322 may be placed at the end of the second section of the tube. At the intersection between first and second sections of the hollow tube, a mirror or other reflective surface may be provided in order to provide an optical path from the sensor 322 to the chamber 312 (and therefore to the surface of the article.)

The optical sensor 322 may be spaced from the chamber housing 312 in a direction perpendicular to the longitudinal axis 330 of the chamber 312. In one example, a cover system (not shown in FIG. 9), may be located between the optical sensor 322 and the chamber 312.

In one example, the apparatus may be configured to provide an airflow in a direction from the sensor 322 to the chamber 312. The airflow may be provided by a user exhaling/inhaling into the space between the sensor 322 to the chamber 312. In another example, an air pump/pressurized source may provide a source of air to enable the air to flow. Providing a flow of air will force "clean" air over the surface of the sensor 322 and prevent aerosol entering the channel from the chamber 312.

The indicia indicative of a parameter of the article includes marker elements that are configured to be sensed by the sensor arrangement to enable a parameter associated with the article to be determined by the controller. In the example shown in FIG. 4, the indicia comprises four marker elements in the form of lines. The marker elements are spaced form each other at varying distances. The arrangement of the marker elements is indicative of a parameter of the article, as described in more detail below. For example, the arrangement of the marker elements may be indicative of the article being a genuine article intended for use with the apparatus, or it could be indicative of the heating profile to be used with this article. The sensor arrangement is configured to provide an input indicative of the parameter of the article to the controller.

Where a second sensor in the form of a capacitive or resistive sensor is used to detect the presence of an electrically conductive reference marker, the reference marker may be provided internally and/or externally of the article. The reference marker may be literally "marked on" the article, such as by printing. Alternatively, the reference marker may be provided in or on the article by other techniques, such as being formed integrally with the article during manufacture. The capacitive or resistive sensors may be configured to monitor for the presence of the reference mark of the article in a first, low power mode. The reference marker may be, for example, a metallic component such as aluminum or a conductive ink or ferrous or non-ferrous coating. The ink may be printed onto tipping paper of the article, using for example a rotogravure printing method, screen printing, ink jet printing, or any other suitable process.

In general, capacitive sensing as used herein operates by effectively sensing a change in capacitance when the article is located within the apparatus 100. In effect, in an embodiment, a measure of the capacitance is obtained. If the capacitance meets one or more criteria, it may be decided that the article is suitable for use with the apparatus, which can then proceed to sense the indicia. Otherwise, if the capacitance does not meet the one or more criteria, it may be decided that the article is not suitable for use with the apparatus, and the apparatus does not function to heat the aerosolizable medium and/or may issue some warning message to the user. In general, capacitive sensing may work by providing the apparatus with (at least) one electrode which in effect provides one "plate" of a capacitor, with the other "plate" of the capacitor being provided by the reference marker of the apparatus mentioned above. When the article is inserted into the apparatus, a measure of the capacitance formed by the combination of the electrode of the apparatus and the article can be obtained, and then compared to one or more criteria to determine whether the apparatus can then proceed to heat the article. As an alternative, the apparatus may be provided with (at least) two electrodes, which in effect provide the pair of "plates" of a capacitor. When the article is inserted into the apparatus, it is inserted between the two electrodes. As a result, the capacitance formed between the two electrodes of the apparatus changes. A measure of this capacitance formed by the two electrodes of the apparatus can be obtained, and then compared to one or more criteria to determine whether the apparatus 100 can then proceed to sense the indicia.

The controller 116 may comprise pre-programmed information, such as a look-up table, that includes details of the various possible arrangements of the indicia and what parameter is associated with each arrangement. Therefore, the controller 116 is able to determine the parameter associated with the article.

The controller 116 may be arranged so that it will only heat an article that it recognizes, and will not operate in conjunction with an article that it does not recognize. The apparatus may be arranged so that it provides some indication to the user that the article has not been recognized. This indication may be visual (for example a warning light, which may for example flash or be illuminated continuously for a period of time) and/or audible (for example a warning "beep" or the like) and/or haptic (for example a vibration). Alternatively or additionally, the apparatus may be arranged so that, for example, it follows a first heating pattern when it recognizes a first type of article and follows a second, different heating pattern when it recognizes a second type of article (and may provide yet further heating patterns for other types of article). The heating patterns may differ in a number of ways, for example the rate of delivery of heat to the aerosolizable medium, the timing of various heating cycles, which part(s) of the aerosolizable medium are heated first, etc., etc. This enables the same apparatus to be used with different basic types of article with minimal interaction required of the user.

Figure 10:
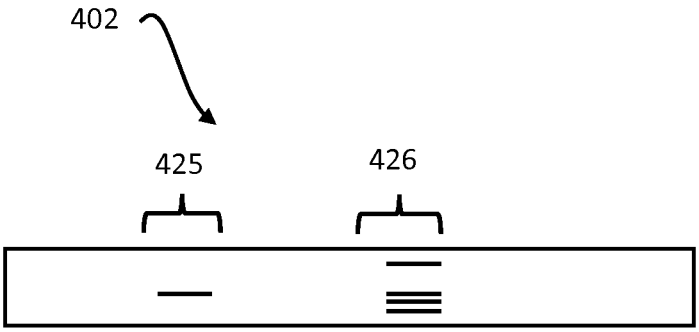
FIG. 10 shows a side view of an example of an article comprising an aerosolizable medium.

FIG. 10 shows a schematic longitudinal side view of another example of an article 402 comprising aerosolizable medium for use with the apparatus 100. As with the article 102 shown in FIG. 4, the article 402 comprises an indicia 426 in the form of optical lines. In this example, the lines extend substantially along the longitudinal axis of the article 402, rather than substantially perpendicular to the longitudinal axis, as is shown in the example of the article 102 in FIG. 4. In some examples, the article may also include a reference marker 425.

In the example shown in FIG. 10, the indicia 426 indicative of a parameter of the article 402 includes four marker elements in the form of lines with a varied spacing therebetween. In one example, the spacing of the marker elements may be such as to create a defined start of the marker element and a defined end of the marker elements. As the article 402 could be inserted into the apparatus 100 in any orientation, the article 402 would need to make a full or partial rotation for all of the marker elements to be read by the sensor arrangement to determine the spacing of the marker elements.

In some examples, the article may have a location feature that enables the consumable to be inserted into the apparatus with a defined orientation. For example, the article may comprise a protrusion or a cut-out feature that corresponds to a shape in the opening 106 of the apparatus. Thus, in some implementations, the article may only be inserted into the apparatus in a single orientation. In the example of the article being subsequently rotated, the starting position would be known and as such there would be no requirement for the article to be rotated by at least 360 degrees. In other examples, the article may have a predefined finger holds or orientation to align or feed into a device (ensuring the consumable is inserted in a predefined manner).

In some examples the sensor arrangement may be arranged at a specific location within the apparatus. For example, the sensor arrangement may be arranged within the chamber and may have a limited detection range. Similarly, the indicia may be arranged at a specific location on, or within the article and may occupy a certain area or volume of the article. To ensure that the indicia is detected when a user inserts the article into the receptacle, it is desirable for the apparatus 100 to be able to restrict the orientation of the article to a single orientation when engaged with the chamber. This may ensure that the indicia is correctly aligned with the sensor arrangement so that it can be detected.

Figure 11:
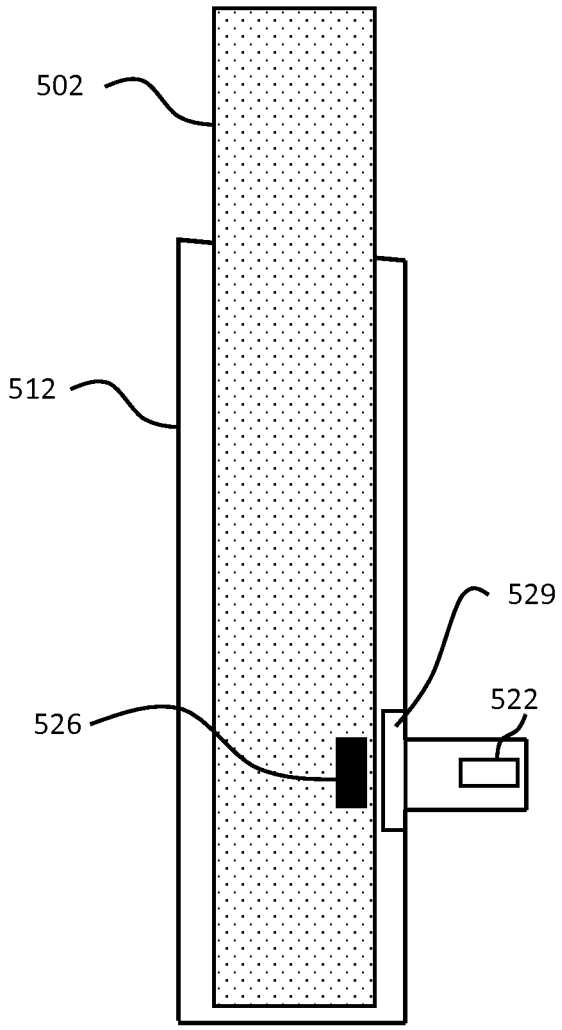
FIG. 11 shows an example cross-sectional view of a chamber, article and sensor arrangement.

FIG. 11 shows a cross-sectional view of another example device, article and sensor. A replaceable cover 529 is located between a sensor 522 and a chamber 512. The replaceable cover 529 has substantially no effect on the signals detected by the sensor 522. For example, if the sensor 522 is an optical sensor, the replaceable cover may be substantially transparent to the wavelengths of light used by the optical sensor. In use, any dirt and/or condensate will form on the replaceable cover 529 and not on the sensor. The replaceable cover can then be replaced with a new one or removed, cleaned and replaced so that the effect on the sensor of any accumulated dirt or condensate is reduced.

In the example of FIG. 11, the replaceable cover 529 covers an opening behind which the sensor 522 is disposed. For example, the replaceable cover may be slid into a recess which defines grooves to retain the replaceable cover in place within the device. Other configurations can also be used, such as a replaceable sleeve which surrounds the whole of the chamber 512, or which extends over part or the full length of the chamber 512.

The replaceable cover can be formed of any suitable material which does not impede the operation of the sensor 522. As the cover may be exposed to relatively high temperatures within the chamber 512, the material may have a suitably high melting point such that the cover does not melt in use. In some examples, the melting point of the cover is greater than 200° C., greater than 250° C. or greater than 300° C. For example, the cover may be formed from Polyetheretherketone (PEEK) or glass.

The article may comprise one or more flavorants. As used herein, the terms "flavour" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

While the above examples have been discussed in terms of an optical sensor and an indicia detectable by an optical sensor, other examples may be applied to other types of sensor. For example, acoustic or sonic sensors, contact switches and RF sensors may also be used to sense a detectable element provided in association with an article. These sensors may also be affected the deposition of dirt and/or condensation during use. The examples discussed above can be applied to equally to systems, devices, articles and methods using these sensors other than optical sensors.

The above embodiments are to be understood as illustrative examples of the disclosure. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An apparatus for generating aerosol from an aerosolizable medium, the apparatus comprising:

a housing;

a chamber for receiving an article, the article comprising:

an aerosolizable medium, and a detectable element provided in association with the article;

a sensor configured to sense the detectable element when an article is received within the chamber; and a cover system, wherein the cover system can be configured in at least a first configuration to substantially cover the sensor, and a second configuration in which a field of view of the sensor is substantially without obstruction.

2. The apparatus according to claim 1, wherein:

the detectable element is an optically detectable indicia provided in association with the article; and the sensor is an optical sensor.

3. The apparatus according to claim 2, wherein the cover system is movable from the first configuration to the second configuration to allow the sensor to read the indicia.

4. The apparatus according to claim 1, wherein the cover system comprises one or more of a pivot, a slide, a spring and latch, and an iris mechanism.

5. The apparatus according to claim 1, wherein the apparatus comprises a second sensor for determining that the article is present in the chamber, wherein the cover system is moved into the second configuration responsive to the second sensor determining that the article is present in the chamber.

6. The apparatus according to claim 1, wherein the cover system is moved into the second configuration in response to an input from a user.

7. The apparatus according to claim 2, wherein the cover system is configured to return to the first configuration after the optical sensor has read the indicia.

8. The apparatus according to claim 1, wherein the cover system is configured to return to the first configuration from the second configuration after a pre-determined period of time.

9. The apparatus according to claim 1, wherein the apparatus is further configured to determine a temperature of at least one of the chamber or the article and operate the cover system on the basis of the determined temperature.

10. The apparatus according to claim 9, wherein the apparatus is further configured to cause the cover system to return to the first configuration from the second configuration when the determined temperature is greater than or equal to a threshold temperature.

11. The apparatus according to claim 8, wherein the apparatus is further configured to enable the cover system to transition from the first configuration to the second configuration when the determined temperature is less than or equal to a threshold.

12. The apparatus according to claim 1, wherein the apparatus comprises one or more aerosol generating elements configured to be activated based on the indicia of the article.

13. The apparatus according to claim 12, wherein the one or more aerosol generating elements comprises a heater arrangement.

14. The apparatus according to claim 13, wherein the heater arrangement is configured to provide a first heating profile if the indicia has a first characteristic, and the heater arrangement is configured to provide a second heating profile if the indicia has a second characteristic different from the first characteristic.

15. An aerosol provision system comprising:
the apparatus according to claim 1; and
an article comprising:
an aerosolizable medium; and
an optically detectable indicia.

16. A method of operating an aerosol generating apparatus according to claim 2, the method comprising:
monitoring for a presence of an article for use with the aerosol generating apparatus, the article comprising an aerosolizable medium and an indicia;
sensing, by the optical sensor, the indicia of the article;
operating the aerosol generating apparatus based on the sensed indicia; and
closing the cover system after sensing the indicia of the article.

17. The method of claim 16, further comprising:
detecting, during the monitoring, the presence of the article; and
responsive to the detecting, opening the cover system to expose the optical sensor to enable the sensing, by the optical sensor, of the indicia of the article.

18. An apparatus for generating aerosol from an aerosolizable medium, the apparatus comprising:
a chamber for receiving an article, the article comprising:
an aerosolizable medium, and
an indicia; and
an optical sensor arrangement for reading the indicia, wherein a surface of the optical sensor arrangement is positioned to contact the article received within the chamber in use.

19. The apparatus according to claim 18, wherein the optical sensor arrangement is positioned such that the article slides past the surface of the optical sensor arrangement during insertion.

20. An article comprising:
an aerosolizable medium; and
an indicia;
wherein at least a portion of an outer surface of the article is compressible and configured to contact an optical sensor arrangement of an apparatus, the apparatus arranged to receive the article and to aerosolize the aerosolizable medium of the article, during insertion of the article into the apparatus for generating aerosol from an aerosolizable medium.

21. A system comprising:
an apparatus according to claim 18; and
an article comprising:
an aerosolizable medium, and
an indicia;
wherein at least a portion of an outer surface of the article is compressible and configured to contact an optical sensor arrangement of an apparatus, the apparatus arranged to receive the article and to aerosolize the aerosolizable medium of the article, during insertion of the article into the apparatus for generating aerosol from an aerosolizable medium.

22. A method of cleaning an apparatus for generating aerosol from an aerosolizable medium, the apparatus comprising a chamber for receiving an article comprising an aerosolizable medium, and an optical sensor arrangement, the method comprising:
inserting an article comprising an aerosolizable medium into the chamber; and
wiping a surface of the optical sensor arrangement with a surface of the article during at least part of the inserting.

23. An apparatus for generating aerosol from an aerosolizable medium, the apparatus comprising:
a chamber for receiving an article, the article comprising an aerosolizable medium and an indicia, wherein the chamber defines a longitudinal axis; and
a sensor for reading the indicia received within the chamber in use, wherein the sensor is spaced from the chamber to define a gap between the sensor and the article received within the chamber in use, wherein the sensor is spaced from the chamber in a direction not parallel to the longitudinal axis,
wherein the apparatus is configured to provide an airflow in a direction from the sensor to the chamber.

24. The apparatus according to claim 23, wherein the sensor is spaced from the chamber in a direction perpendicular to the longitudinal axis of the chamber.

25. The apparatus according to claim 23, wherein the sensor is positioned in a recess connected to the chamber.

26. The apparatus according to claim 23, wherein the sensor is spaced at least 1 cm away from the article received in the chamber in use.

* * * * *